US005773730A

United States Patent [19]

McConnell et al.

[11] Patent Number: 5,773,730

[45] Date of Patent: Jun. 30, 1998

[54] METHOD AND APPARATUS FOR SAMPLING ROOM-AIR CONDITIONS FOR HVAC CONTROL

[75] Inventors: Douglas Carl McConnell, Hialeah; Winfield LeRoy Kelley, Miami, both of Fla.

[73] Assignee: Warren Technology Inc., Hialeah, Fla.

[21] Appl. No.: 782,101

[22] Filed: Feb. 13, 1997

Related U.S. Application Data

[63] Continuation of Ser. No. 572,643, Dec. 14, 1995, abandoned.

[51] Int. Cl.[6] ..... F24F 7/00

[52] U.S. Cl. ..... 73/863.83

[58] Field of Search ..... 73/863.81, 863.83; 374/208; 356/440; 236/49.1–49.5; 454/237, 241, 243–245, 248

[56] References Cited

U.S. PATENT DOCUMENTS 4,181,253 1/1980 Barlow .
4,478,048 10/1984 Dills ..... 236/49.3
5,119,987 6/1992 Kobayashi .
5,377,528 1/1995 Dauvergne .

FOREIGN PATENT DOCUMENTS 87546 4/1988 Japan ..... 236/49.3
223754 9/1990 Japan ..... 236/49.1

*Primary Examiner*—Robert Raevis
*Attorney, Agent, or Firm*—Nikaido Marmelstein Murray & Oram, LLP

[57] ABSTRACT

An apparatus for sampling room air-conditions comprising a sensor well having a discharge opening into which sensor well is placed a sensor, a fan for passing room-air past the sensor, a discharge plenum outside of the sensor well for receiving room-air discharged from the sensor well discharge opening and diffusers for discharging received room-air in directions away from the room-air sensor well. A method for sampling room-air conditions wherein the room-air is passed by a sensor, dispensed in directions to envelop the room-air to be sensed and prevented from contacting or mixing with the room-air to be sensed by the sensor with air not passing the sensor.

12 Claims, 1 Drawing Sheet

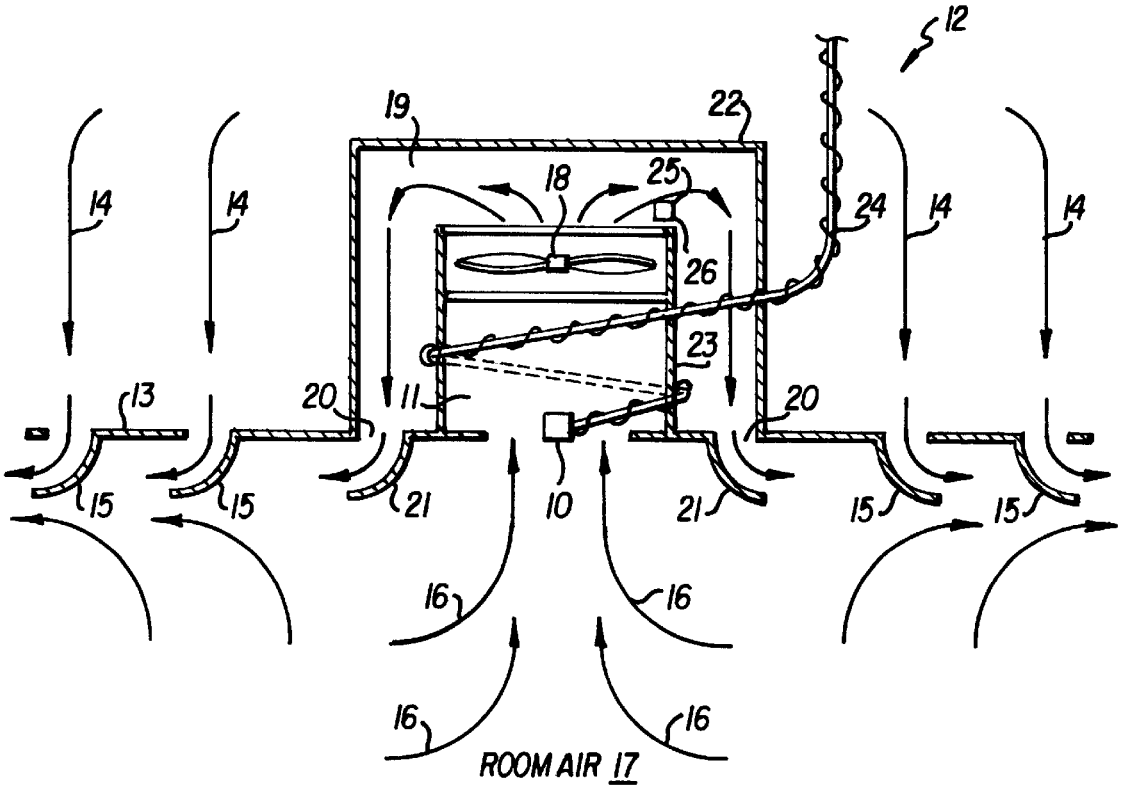
12
19
22
18
25
14
14
24
14
14
26
23
13
20
11
20
15
15
21
10
21
15
15
16
16
16
16
ROOM AIR 17

METHOD AND APPARATUS FOR SAMPLING ROOM-AIR CONDITIONS FOR HVAC CONTROL

This is a continuation of application Ser No. 08/572,643, filed Dec. 14, 1995, now abandoned.

The present invention relates to a method and apparatus for accurately sampling room air conditions for controlling high volume air conditioning.

BACKGROUND OF THE INVENTION

The classical method for measuring HVAC comfort conditions in a room is the use of wall-mounted sensors for temperature (thermostat), moisture (humidistat), or air quality (carbon dioxide, carbon monoxide, smoke particles or gaseous products of combustion). The sensor gives a reading which is then compared to a setpoint and a mechanical system responds to bring the room conditions closer to the setpoint.

The location of the sensor is very important. If a thermostat is placed in direct sunlight, its reading will be too high. If a thermostat is placed on an outside wall, in the winter, its reading will be too low. The readings can be several degrees off in these cases, which causes the HVAC system to overcool or overheat the room. Similar problems can arise if the occupancy, lighting and office-equipment is in a different area of the room than the sensor. If a thermostat is located next to the door of a large room, it might not respond properly to heat gain occurring inside the room, so the room will be under-cooled.

Humidity and contaminant sensors need a correct sample of the molecular makeup of the air. If the sensor is next to an outside door, infiltrating air can make the reading inaccurate. If the sensor is located directly in the airstream of a supply-diffuser, the supply-air will influence the sensor's reading. Alternatively, if the sensor is in a location where there is no air circulation, changes in the average room conditions will transfer very slowly to the sensor, resulting in wide swings in room conditions, since the conditioning system gets out of synchronism with the true needs.

The optimal sensor location is in the ceiling near the center of the room. It accurately represents the average conditions of the room, under a wide variety of circumstances. It is not in direct sun, not on an outside wall, not near a doorway, nor in a stagnant corner. The best circumstances for getting a true and timely measurement of the average conditions is to have well-mixed room-air continually moving past the sensor. One of the effects of blowing conditioned supply-air into a room is to induce and entrain secondary room-air. The resulting currents and eddies mix the air into an average representation of the room conditions. Since most supply-air diffusers are in or near the ceiling, the secondary air is drawn to the ceiling. Even if no air is currently being supplied to the space, natural convective forces cause low-velocity currents to gradually mix the room-air and move it pass the ceiling.

For several years, a number of manufacturers have offered ceiling-mounted supply-air diffusers with integral thermostats. However, there have been significant problems with these devices:

a. The sensors are "buried" inside the housing of the diffuser, which allows the sensor to be affected by the temperature of the supply-air, since all of the metal surrounding the sensor tends to be the temperature of the supply-air, rather than the room temperature.

b. Some of the diffuser-sensors use air pressure from the supply-air to induce room-air to flow into the diffuser and around the sensor. Two problems occur i. The amount of induced air is a function of the pressure in the diffuser, or of the amount of air being supplied by the diffuser. When used with variable-volume devices, there are significant periods of time during which very little induction actually occurs. In the case of one large manufacturer, the problem is so great that a special electronic circuit has to force the diffuser to open up every 4–5 minutes just so the sensor can get a sample of room-air—this creates over-cooling, extra noise, and slow response to changing loads in the room.

ii. The second problem is that in all existing devices there is with this method significant contamination of the room-sample air by supply-air which "short-circuits" back into the sensing chamber. That is, instead of sampling room-air, the sensor is reading a mixture of supply-air and room-air. The amount of contamination varies with flow-rate through the diffuser. Again, one large manufacturer has found the problem to be significant enough to create electronic "fudge factors" which reinterpret the sensor reading to attempt to counteract these effects.

It therefore is an object of the invention to prove a method for air movement which will more accurately reflect room-air conditions.

Another object of the invention is to provide apparatus to control air movement to reflect more accurately room-air conditions.

Another object of the invention is to provide a method whereby room-air at point of measurement is kept separate from supply-air.

A further object of the invention is to provide apparatus enabling supply-air to be kept separate from the room-air at point of measurement.

A still further object of the invention is to provide a method whereby supply-air is used to induce secondary air past a sensor.

Another object of this invention is to provide a method whereby well mixed room-air is brought past the sensor.

Still another object of the present invention is to provide an apparatus to eliminate conductive heat transfer from the supply-air to the sensor.

Another object of the present invention is to provide apparatus to insulate the sensor well from radiative and convective heat-transfer effects of the supply-air.

SUMMARY OF THE INVENTION

The present invention relates to a method of and apparatus for sampling room-air to ensure continuous, accurate and timely indication of changes in temperature, humidity, and/or air quality of the room. The method's specific application is in conjunction with a ceiling-diffuser which creates superb secondary-air induction, thus assuring well-mixed room-air, and circulation patterns which bring the room-air near to a sensor.

The room-air having passed the sensor is discharged back into the room so that a wall is created between the room-air passing the sensor to be sensed and the supply-air in order to give a more accurate indication of air conditions. The supply-air is diffused in a manner to mix with room-air and induce room-air circulation into the vicinity of the sensor. The sensor hangs within a shallow well which is fitted within a discharge plenum which in turn surrounds the sensor/plenum assembly.

BRIEF DESCRIPTION OF THE FIGURE

Other details and features of the invention will stand out from the description given below by way of non-limitative example and with reference to the accompanying figure, which schematically depicts an apparatus according to a preferred embodiment of the present invention.

DESCRIPTION OF THE PREFERRED EMBODIMENT

Referring to the FIGURE, sensor 10 hangs inside a shallow well 11 in the center of a diffuser 12 in the ceiling 13. The diffuser 12 supplying supply-air 14 blows supply-air 14 outwardly away from the sensor 10 through diffuser plates 15 and induces the room-air circulation patterns 16 directly into the vicinity of the sensor 10. The shallow well 11 opens directly to the room 17 with the sensor 10 mounted at the bottom of the well 11 flush with the ceiling 13. Even if the high velocity air conditioner system (HVAC) were turned off, natural convection of room-air would provide good sampling of the room-air 16. A very small constant-volume fan 18 pulls air from the room 17, over the sensor 10 and blows it back into the room 17. The sensor fan 18 operates continuously, whenever the HVAC system is on, regardless of the room conditions or supply-air 14 temperature or flow-rate. The fan 18 is mounted in the top of the sensor well 11 and discharges room-air 16 into a plenum 19 that surrounds the sensor well 11. The bottom of the plenum 19 has diffuser holes 20 with plates 21 to let the room-air out, directing the room-air outwardly in four directions, away from the sensor 10. The plenum discharge-air pattern further assists in isolating the room-air sample 16 from the supply-air 14. The supply-air 14 also blows outwardly away from the sensor 10. The sensor-discharge air passing through holes 20 also blows outwardly away from the sensor 10 and acts as a wall between the supply-air 14 and the room inlet air 16. The sensor inlet-discharge pattern does not vary with time, so the accuracy of the sample is maintained under all operational conditions. A discharge-plenum casing 22 also serves to insulate the sensor-well 11 from radiative and convective heat transfer that might otherwise come from the supply-air 14 that surrounds the sensor/plenum assembly. The plenum casing 22 is made of an insulating plastic material. The continuous flow of discharge air from fan 18 carries away any heat or cold that passes through the plenum casing 22. The shell 23 of the inner sensor-well 11 also is made of an insulating material which further protects sensor 10.

Insulated wires 24 that lead to the sensor 10 necessarily run through the supply-air diffuser 12. To counteract the conductive heat or cold that could travel along the wires to the sensor 10, enough wire is maintained within the sensor's 10 discharge plenum 19 to offset the temperature differential.

When humidity sensing is required, the humidity sensor like the temperature sensor is placed within the shallow well 11 to assure that the relative humidity measurement is not affected by thermal heat-transfer from the supply-air 14. When carbon dioxide, smoke or other gaseous sensing is needed, those sensors 25 can be located in the discharge plenum 19 and connected to a power source through insulated wires 26 since they are not affected by the minimal amount of heat or cold transfer which occurs at that point.

Various modifications of the specific embodiment described and shown may be made, and it is understood that the specific embodiment is by way of illustration of the invention and not limiting thereto.

We claim:

1. Apparatus for sampling air conditions in a room comprising a first sensor for determining room air conditions, means forming a sensor well into which said sensor is placed, said sensor well having an inlet opening and a separate discharge opening, means within said sensor well for drawing room air past said sensor positioned in said sensor well to determine a said room air condition, means forming a discharge plenum outside of said sensor well for receiving only sensed room air discharged from said discharge opening of said sensor well, discharge means for discharging from said discharge plenum only said received sensed room air in directions away from said room air sensor well, and an air supply plenum including means to diffuse supply air into said room, said sensed room air discharged from said discharge plenum forming a boundary layer of air between said room air to be sensed at said sensor well and said supply air diffused into said room.

2. The apparatus according to claim 1, wherein said discharge means are diffusers.

3. The apparatus according to claim 2, wherein said sensor has wrapped wire leads extending from said supply-air plenum through said discharge plenum and wrapped around said sensor well to said first sensor to eliminate conductive heat-transfer from the supply-air through the wires to said first sensor.

4. The apparatus according to claim 1, wherein said means for drawing is a constant-volume fan.

5. The apparatus according to claim 1, wherein the sensor well is made of an insulating material.

6. The apparatus according to claim 1, wherein the discharge plenum is made of an insulating material.

7. The apparatus according to claim 1, including a second sensor positioned within said discharge plenum.

8. The apparatus according to claim 7, wherein said second sensor registers carbon dioxide, carbon monoxide, smoke particles, or gaseous products of combustion.

9. The apparatus according to claim 1, wherein said first sensor registers the temperature.

10. The apparatus according to claim 1, wherein said first sensor registers the humidity.

11. The apparatus according to claim 1, wherein said first sensor registers carbon dioxide, carbon monoxide, smoke particles or gaseous products of combustion in the air.

12. Apparatus for supplying fresh air to a room and for sensing a physical condition of air contained in the room which comprises:

first chamber means forming a well chamber and providing first and second openings, said first opening communicating with said room, second chamber means surrounding a portion of said first chamber means to define a plenum chamber around said first chamber means, said second chamber means providing a third opening communicating with said room, said second opening of said first chamber means communicating with said plenum chamber, a sensor means located near said first opening of said first chamber means for sensing a condition of air in said room as said air flows therepast, draft means for drawing air exclusively from said room through said first opening of said first chamber means and past said sensor means into said well chamber, then through said second opening into said plenum chamber, and out of said third opening of said second chamber means back into said room, discharge means for directing room air passing from said plenum chamber through said third opening back into said room so as to flow away from said first opening, and an air supply plenum including means to diffuse fresh air into said room, said sensed room air discharged from said discharge plenum forming a boundary layer of air between said room air to be sensed at said sensor well and said fresh air diffused into said room.

* * * * *